United States Patent [19]

Bollinger

[11] 4,292,185

[45] Sep. 29, 1981

[54] POLYMERIC ADDITIVE FOR LUBRICANTS AND FUELS

[75] Inventor: Joseph M. Bollinger, North Wales, Pa.

[73] Assignee: Rohm and Haas Company, Philadelphia, Pa.

[21] Appl. No.: 108,443

[22] Filed: Dec. 31, 1979

[51] Int. Cl.[3] ..... C10M 1/38

[52] U.S. Cl. ..... 252/47.5; 44/71; 44/76; 525/131

[58] Field of Search ..... 252/47.5, 51.5 A; 525/131, 332, 333, 351; 44/71, 76

[56] References Cited

U.S. PATENT DOCUMENTS

| | | | |
|---|---|---|---|
| 3,325,418 | 6/1967 | Stuart | 252/47.5 X |
| 3,328,297 | 6/1967 | Anderson | 252/47.5 X |
| 3,352,782 | 11/1967 | Brasch | 252/47.5 |
| 3,496,249 | 2/1970 | Hitzler et al. | 252/51.5 A X |
| 3,844,965 | 10/1974 | Brown | 252/51.5 A |
| 3,855,348 | 12/1974 | Pautrat et al. | 525/331 |
| 3,941,834 | 3/1976 | Lee | 252/47.5 X |
| 4,151,222 | 4/1979 | Hergenrother et al. | 525/131 X |

*Primary Examiner*—Andrew Metz

[57] ABSTRACT

Polymeric additives comprising a diene-modified mono-olefinic backbone polymer functionalized with chlorosulfonyl isocyanate and post-reacted with a nitrogen compound. The additives impart combined detergent, viscosity index improvement and other useful properties to lubricating oils and hydrocarbon motor fuels.

17 Claims, No Drawings

POLYMERIC ADDITIVE FOR LUBRICANTS AND FUELS

BACKGROUND OF THE INVENTION

This invention relates to polymers useful as multipurpose additives for lubricating oils and hydrocarbon motor fuels. More particularly, this invention concerns diene-modified mono-olefinic backbone polymers functionalized with chlorosulfonyl isocyanate and post-reacted with a nitrogen compound. The polymers combine viscosity index improvement with detergent properties when used in lubricating oils and hydrocarbon motor fuels.

The continuing search for multi-purpose lubricating oil and hydrocarbon motor fuel additives has led recently to families of graft copolymers. Representative of these additives are polyolefinic viscosity index improving backbone polymers grafted with polar monomers such as methyl methacrylate, N,N-diethylaminoethyl methacrylate, C-vinylpyridine and N-vinylpyrrolidone, as in U.S. Pat. Nos. 3,404,091, 3,687,849 and 4,146,489. Other developments have proceeded along the lines of incorporating the polar functionality needed for detergency by grafting monomers such as maleic anhydride onto a polyolefinic backbone polymer and then post-reacting the carboxylic functionality of the maleic anhydride with polar compounds containing nitrogen and/or oxygen, such as amines and alkane polyols, as in U.S. Pat. Nos. 3,914,203, 4,033,888, 4,033,889, 4,036,772, 4,089,794 and 4,169,063.

The development of such polymeric additives, however, has not been without difficulty, due in part to the presence or the formation of haze in concentrates of the polymeric additives. The haze normally does not detract from the end use properties of the additives but it is undesirable from the standpoint of consumer acceptance and general marketability. Attempts to cure this problem have led to improvements involving nitrogen containing monomer or maleic anhydride grafting such as described in U.S. Pat. Nos. 4,069,162, 4,160,739, 4,161,452 and 4,144,181. Nevertheless, monomer grafting techniques continue to involve problems of control, in terms of homopolymer by-product formation, haze due to gelation and other causes, dispersancy levels (in terms of yield of active product or percent product derivitized), and balance of properties.

Other attempts to produce multipurpose additives for lubricating oils and hydrocarbon motor fuels have involved incorporating the polar functionality required for detergency by including polar monomers with the monomers used to form the substrate polymer, or by treating a polymeric substrate with oxidizing agents or other reactants for direct derivatization of the polymer. U.S. Pat. No. 3,328,297 to Anderson discloses the incorporation of polyamino functionality into polyolefinic substrate polymers by functionalizing the substrate polymer with chlorosulfonyl isocyanate and then post-reacting with an alkylene polyamine or polyalkylene polyamine. However, the products obtained have been found lacking in viscosity index (VI) improving properties. Moreover, when in the course of the work leading to the present invention it was attempted to incorporate the VI improving properties by substituting a higher molecular weight version of the polyolefin as the substrate polymer in the examples of the patent, the percent of product derivitized was lower than expected and certain of the products, such as those prepared from polyisobutylene-isoprene substrate polymer were oil-insoluble and therefore useless as lubricating oil or motor fuel additives.

The present invention therefore has as an object the provision of multi-purpose additives for lubricating oils and hydrocarbon motor fuels based upon the derivitization of polymeric viscosity index improving materials, by functionalization with chlorosulfonyl isocyanate followed by reaction with a nitrogen compound thus providing high yield (approaching 100% active material) of active product but without substantial gel formation and production of the haze which often accompanies graft polymerizations.

SUMMARY

Briefly, in one aspect of the invention the foregoing object is achieved by selecting as the polymeric viscosity index improving substrate material a diene-modified mono-olefinic backbone polymer which is then functionalized with chlorosulfonyl isocyanate and post-reacted with a nitrogen compound. It has been discovered that a mono-olefinic polymer modified to contain non-conjugated diene residues, as contrasted with utilizing a backbone polymer containing the residue of a conjugated diene (such as is normally present in polyisobutylene-isoprene, partially hydrogenated polybutadiene, or partially hydrogenated polyisoprene), avoids or substantially minimizes the foregoing problems. In another aspect of the invention, additional improvements result when the reaction mixture is neutralized after reaction with the nitrogen compound. In still another aspect of the invention, the chlorosulfonyl functionality may be removed before reaction with the nitrogen compound, for example by treatment with aqueous bisulfite, thereby making the derivitized product more suitable for use in hydrocarbon motor fuels.

DETAILED DESCRIPTION

The backbone or substrate polymers, useful in preparing the multipurpose additives of the invention, are any mono-olefinic polymers which have been modified by incorporation into the monomer mixture from which the polymers are prepared by one or more non-conjugated diolefins. From about 1 to about 10 mole percent of the diolefin is effective, preferably about 2.5 to about 8 mole percent. The mono-olefinic component may comprise a single mono-olefin or mixture of different mono-olefins and may contain from 2 to about 20 or more carbon atoms. The mono-olefins may contain the olefinic unsaturation either terminally or medially and may be linear or branched. Preferably, the mono-olefinic component contains a major proportion of alpha-mono-olefin. Representative mono-olefins include ethylene, propylene, 1-butene, 1-pentene, 4-methyl-1-pentene, 1-hexene, 1-heptene, 1-octene, 1-nonene, 5-methyl-1-nonene, 1-decene, 5,5-dimethyl-1-octene, 4-methyl-1-hexene, 4,4-dimethyl-1-pentene, 5-methyl-1-hexene, 4-methyl-1-heptene, 4,4-dimethyl-1-hexene, 5,6,6-trimethyl-1-heptene, and the like. Particularly preferred olefinic polymers are hydrocarbon polymers prepared from mixtures of ethylene, propylene and the non-conjugated diene, such as described in U.S. Pat. No. 4,033,889, and are known in the art as "EPDM" polymers.

The non-conjugated diene modifiers include any acylic (straight or branched chain) or alicyclic (single or multi-ring) diolefin having from about 5 to about 15 carbon atoms of which the following are representative: 1,4-cyclopentadiene, 2-methylene-5-norbornene, ethylidene norbornene, 1,4-hexadiene, 1,5-heptadiene, 1,6-octadiene, dicyclopentadiene, 2,4-dimethyl-2-octadiene, 3-(2- methyl-1-propene)cyclopentene, and the like, including any mixtures thereof.

The foregoing and other diene-modified mono-olefinic substrate polymers are well known in the art and many are commercially available.

The diene-modified mono-olefinic substrate polymers are selected from the standpoint of lubricating oil solubility, shear stability, and viscosity index improving properties. Accordingly, the polymeric substrates in their final use form will have molecular weights in the range of from about 10,000 to about 200,000 viscosity average molecular weight, and more usually about 70,000 to 150,000. It is possible to form the derivitized products of the invention with higher molecular weight substrate polymers (about 200,000 to 1,000,000) and then reduce the molecular weight by homogenization or other known polymer degradation technique. Such procedure, although introducing an added expense and process complexity, may be required if the only polymers commercially available have the higher molecular weights.

For the derivitization reaction, any nitrogen compounds known in the art as being capable of imparting dispersant activity to the substrate polymer will be useful. In this connection the same nitrogen-compound derivatized polymers may exhibit different dispersancy values when evaluated in different test procedures or when rerun in the same test at different times. For example, although poor dispersancy may be indicated when the products are evaluated in the well-known asphaltenes test, different conclusions may be reached on the basis of the pyrruvic acid dispersancy test or actual engine tests. Accordingly, one skilled in the art normally will consider the results of more than one test procedure before excluding a product as being a non-dispersant or as having insufficient dispersancy.

Generally, the nitrogen compounds are hydrocarbyl compounds containing at least one primary or secondary nitrogen atom, including $C_1$ to $C_{18}$ monoamines such as ethyl amine, butylamine, diethylamine, and the like; alkylene polyamines and polyalkylene polyamines such as polyamines of the formula $$NH_2(CH_2)_n\text{-}[NH(CH_2)_n]_m\text{—}NH_2$$

where n is 2–4 and m is 0–6; and a variety of other amines containing aliphatic, cycloaliphatic, aromatic and/or heterocyclic groups. The amines may also carry other functional groups, such as hydroxyl, and may contain heterocyclic oxygen atoms, provided such groups or atoms do not cause interfering reactions. A surprising and unexpected feature of the present invention is that the polyamines of the above formula, although containing terminal primary and/or secondary amino groups, do not cause substantial insolubility or gelation of the products. Gelation would be expected, a priori, when forming the relatively high molecular weight substrate materials of the present invention as opposed to the lower molecular weight polymers of U.S. Pat. No. 3,328,297 due to the substantially greater number of reactive sites for crosslinking in the substrate polymers of the present invention.

Non-limiting examples of nitrogen compounds useful in the present invention are ethylenediamine, diethylenetriamine, triethylenetetramine, tetraethylenepentamine, pentaethylenehexamine, di(trimethylene)triamine, trimethylenediamine, hexamethylenediamine, tetramethylenediamine, di(hexamethylene)triamine, N-(2-aminoethyl)piperazine, N,N'-di(2-aminoethyl)piperazine, dimethylamino-ethylamine, dibutylaminoethylamine, 3-dimethylamino-1-propylamine, 4-methylethylamino-1-butylamine, pyridyl-ethylamine, N-morpholino-ethylamine, tetrahydropyridyl-ethylamine, bis-(dimethylamino)propylamine, bis-(diethylamino)ethylamine, N,N-dimethyl-p-phenylene diamine, piperidylethylamine, 1-aminoethyl pyrazone, 1-(methylamino)-pyrazoline, 1-methyl-4-aminooctyl pyrazole, 1-aminobutyl imidazole, 4-aminoethyl thiazole, 2-aminoethyl triazine, dimethylcarbamyl propylamine, N-methyl-N-aminopropyl acetamide, N-aminoethyl succinimide, N-methylamino maleimide, N-aminobutyl-alpha-chlorosuccinimide, 3-aminoethyl uracil, 2-aminoethyl pyridine, ortho-aminoethyl-N,N-dimethylbenzenesulfamide, N-aminoethyl phenothiazine, N-aminoethylacetamidine, 1-aminophenyl-2-methylimidazoline, N-methyl-N-aminoethyl-S-ethyl-dithiocarbamate, N-phenylurea, aminoethylethylene urea, N-(3-aminopropyl)morpholine, 4-aminomethylpyridine, 2-(2-aminoethyl)pyridine, N-(3-aminopropyl)-2-pyrrolidinone, N-(3-aminopropyl)-N'-methylpiperazine, 1-(2-aminoethyl)-2-methyl-2-imidazoline, N-(5-aminopentyl)-2,5-dimethylpyrrole, 2-aminothiazole, 2-aminobenzothiazole, and other aminoalkyl-substituted piperidines, morpholines, piperazines, pyridines, pyrrolidines, pyrroles, benzopyrroles, quinolines, indoles and the like.

Polyamines having nonreactive nitrogen in other groups are also useful, such as substituted primary or secondary amines in which the substituent is derived from pyrrolidones, caprolactams, oxazolidones, oxazoles, thiazoles, pyrazoles, pyrazolines, imidazoles, imidazolines, thiazines, oxazines, diazines, oxycarbamyl, thiocarbamyl, uracils, hydantoins, thiohydantoins, guanidines, ureas, sulfonamides, phosphoramides, phenothiazines, amidines, and the like.

The reaction of chlorosulfonyl isocyanate with the polymeric substrate is normally conducted in an inert (aprotic), non-toxic solvent such as a low bromine number oil, heptane, or toluene. (The effectiveness of non-toxic solvents when preparing the products of the invention is a significant advantage over the graft polymerizations used to make other dispersant VI improving polymers. The latter syntheses often involve the use of toxic solvents such as benzene and halogenated benzenes.) The reaction proceeds well at room temperature, although higher or lower temperature may be used. The reaction may be conducted in the absence of oxygen and moisture as described in U.S. Pat. No. 3,855,348 but the reaction is also effective in contact with dry air. From about 25% of the stoichiometric amount to about a 20% by weight excess over stoichiometry of chlorosulfonyl isocyanate based on polymeric substrate is a useful range. The polymeric substrate is advantageously first dissolved in an inert solvent, such as a mixture of methylene dichloride and mixed hexanes, and then the chlorosulfonyl isocyanate is added. The reaction mixture is then agitated for a suitable period of time, for example from about 1 to 16 hours, and stripped of solvent while adding neutral oil. The nitrogen compound is then added, preferably at about room temperature, in an amount providing a mole ratio of nitrogen compound to sulfonylchloride isocyanate of about 0.1 to 1 to about 2:1. Preferably, the nitrogen compound is used in a molar excess, up to about 2:1 mole ratio of nitrogen compound to sulfonylchloride isocyanate. After rection for a suitable period of time, for example for about 1 to 5 hours, the reaction product is neutralized by addition of sodium hydroxide or other suitable alkaline reagent, and the excess amine and water is removed as by vacuum stripping or the like.

As evident from Example 5 following, no treatment with an alkanol prior to reaction with the nitrogen compound is required, as in the examples of U.S. Pat. No. 3,328,297. In fact, it has been found that higher dispersancy is obtained when the alkanol treatment is avoided.

The reaction of chlorosulfonyl isocyanate with the substrate polymer is believed to be primarily a cycloaddition to form a $\beta$-lactam group (equation (1) below), providing two reactive sites for incorporation of the nitrogen compound (equation (2) below, using dimethylaminopropyl amine as representative of the nitrogen compound reactant) as sulfamide and amino amide:

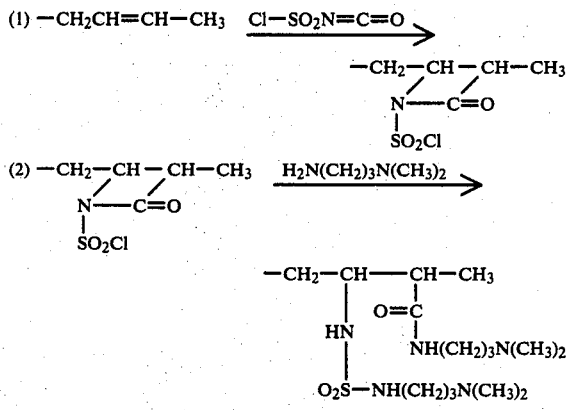

However, the reaction mixture from the chlorosulfonyl isocyanate reaction may also contain "ene" reaction products (equation (3) below) and the nitrogen incorporation probably is as sulfamide only (equation (4) below):

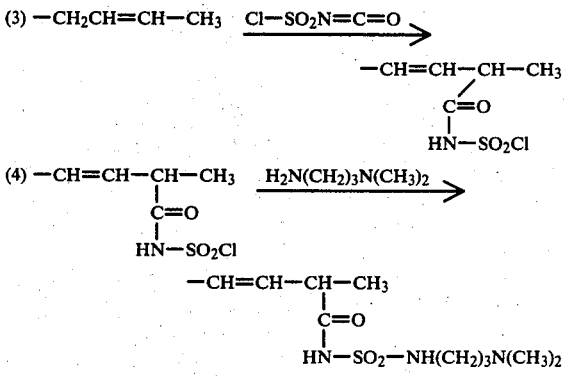

As indicated, useful products according to the invention can also be obtained by removal of the chlorosulfonyl group (by sodium bisulfite addition or equivalent reaction) from the cycloaddition product of equation (2), and the product then being reacted with the nitrogen compound (as in equations (5) and (6) below):

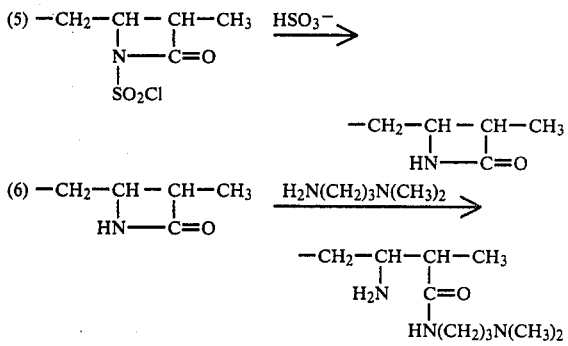

The reaction sequence illustrated by equations (5) and (6) thus provides products from which sulfur has substantially been eliminated. Although the added cost of the bisulfite treatment may not be warranted when the products are to be used as lubricating oil additives, the sulfur elimination step may be important for use of the final products in hydrocrbon motor fuels in which sulfur is undesirable, from the standpoint of avoiding formation of pollutants or corrosives in the combusion products, for example.

The products of this invention may be used in a wide variety of fuels and lubricants. They are primarily of utility in lubricants, where both their superior dispensancy and their influence on viscosity-temperature control are of value. Appropriate lubricant base stocks include oils of both mineral (petroleum) and synthetic origin. The oils may vary in viscosity from spindle oils to motor oils to gear oils. Suitable synthetic fluids include esters such as dialkyl adipate, dialkyl sebacate, or dialkyl azelate, triesters of trimethylolpropane, tetraesters of pentaerythritol, polyalkyleneglycol esters, phosphate esters, or synthesized hydrocarbons of the poly-$\alpha$olefin or alkylbenzene types. Typical applications include hydraulic fluids, automatic transmission fluids, automotive crankcase oils, gear oils, and greases.

The products of this invention may be used in lubricants at about 0.1% to about 10.0% by weight, preferably about 0.3-5.0% by weight, but more typically at about 0.5% to about 2.0%. As these products are rubbery solids, they are routinely manufactured as viscous concentrates at about 7 to about 15% solids in oil, and the commercial user would accordingly use an amount of the concentrate giving the above recited range of polymeric ingredient.

The lubricants containing the products of this invention may also include other additives to provide additional dispersancy, viscosity-temperature control, pour point depressancy, high temperature detergency, rust inhibition, anti-wear agents, antioxidants, extreme pressure agents, friction modifies, anti-foam agents or dyes. Accordingly, there may be used with the products of this invention polybutene-bases succinimides or esters, phosphosulfurized polybutenes, polyacrylates or polymethacrylates, polyisobutylene, ethylene/propylene copolymers or terpolymers hydrogenated styrene-butadiene or styrene-isoprene, N-vinylpyrrolidone- or dimethyl- aminoethyl methacrylate-containing copolymers with methacrylates, styrene polyesters, ethylene-vinyl acetate copolymers or oligomers, dialkyl fumarate polymers or copolymers, esterified styrene-maleic anhydride copolymers or oligomers, hydrocarbon wax-naphthalene condensates of the Friedel-Crafts type, chlorinated hydrocarbons, alkaline earth sulfonates, phenates, salicylates or phenate sulfides, alkaline earth alkylnaphthalene sulfonates, zinc or other metallic dialkyldithiophosphates or diaryldithiophosphates, zinc, cadmium, lead, molybdenum, or other metallic dithiocarbamates, sulfurized or phosphosulfurized esters or terpense, hindered phenols, phenothiazine or alkylated phenothiazines, naphthylamines, phenylenediamines, dibenzyl disulfide, sulfurized diisobutylene or tri-isobutylene, trialkyl or triaryl phosphites, tricresyl phosphate or silicone polymers, and the like.

When the products of this invention are used in hydrocarbon motor fuels, where primary use is made of their superior dispersancy, generally lower levels will be used, typically about 0.001% to about 0.1% by weight. The fuels include both gasoline and diesel types, and may also contain other additives such as antioxidaants, metal deactivators, stabilizers, anti-rust agents, injector detergents, induction system deposit control additives or other carburetor detergents.

Throughout this specification and the following illustrative examples, all parts and percentages are by weight, unless otherwise stated. The detergency test data are based on the Asphaltenes Test, described below.

ASPHALTENES TEST FOR DISPERSANCY

A method for determining the dispersing activity of any given polymer is based on the capacity of the polymer to disperse asphaltenes in a typical mineral oil. The asphaltenes are obtained by oxidizing a naphthenic oil with air under the influence of a trace of iron salt as catalyst, such as ferric naphthenate. The oxidation is desirably accomplished at 175° C. for approximately 72 hours by passing a stream of air through a naphthenic oil to form a sludge which may be separated by centrifuging. The sludge is freed from oil by extraction with pentane and taken up with chloroform. The resulting solution is adjusted to a solids content of about 2% (weight by volume). When a polymer is to be examined for its dispersing activity, it is dissolved in a standard oil, such as a solvent-extracted 100 neutral oil. Blends may be prepared to contain percentages varying from about 2% to about 0.01% or even lower of polymer in oil.

A 10 ml sample of a blend is treated with 2 ml of the standard solution of asphaltenes in chloroform. The sample and reagent are thoroughly mixed in a test tube and the tube is placed in a forced draft oven at either 90° C. or 150° C. for two hours to drive off volatile material. The tube is then allowed to cool and the appearance of the sample is noted. If the polymer has dispersing activity, the oil will appear clear although colored. Experience has usually demonstrated that unless a polymer exhibits dispersing activity at concentrations below about 2% in the Asphaltenes Test, it will fail to improve the cleanliness of engine parts in actual engine tests.

The Asphaltenes rating scale used to obtain the test data in the examples below is the following:

| Rating | Concentration (%) Showing Dispersancy |
|---|---|
| 1P | 2.0 |
| 2P | 1.0 |
| 3P | 0.5 |
| 4P | 0.25 |
| 5P | 0.12 |

-continued

| Rating | Concentration (%) Showing Dispersancy |
|---|---|
| 6P | 0.06 |

EXAMPLE 1

In a 500 ml 3-neck flask are placed 30 g. of a commercially available ethylene/propylene/diene terpolymer wherein the diene is 1,4-hexadiene (about 2.5 mole %) and the proportion of ethylene to propylene is about 50/50 [Ortholeum 2052, DuPont], 200 ml methylene chloride and 100 ml of mixed hexanes. This mixture is stirred until the polymer dissolved and a homogeneous solution is obtained (about 5 hours). Then 2.5 g. of chlorosulfonyl isocyanate is added, and the reaction stirred for 4 hours and allowed to stand for 16 hours. After a further 4 hours of stirring, the solvent is removed at atmospheric pressure while adding 170 g. of 100 neutral oil. A final stripping under vacuum is performed at 0.5 mm to 120° C. flask temperature. The flask is cooled to 30° C. and 30 g. of dimethylaminopropylamine is added. After the reaction is stirred for 2 hours, 1.0 ml of 50% aqueous NaOH is added and excess amine and water is removed at 0.5 mm to a flask temperature of 130° C. The product shows 5P (90° C.) and 4P (150° C.) asphaltenes dispersancy. Infrared spectroscopy of intermediate material (before amine is added) shows an adsorption at about 1830 $cm^{-1}$ characteristic of a $\beta$-lactam. This band is absent in the final product. Fractionation of polymer on silicic acid shows that 84% of the polymer is functionalized. Elemental analysis on isolated polymer shows the polymer to contain 0.66% nitrogen (Kjeldahl) and 0.54% sulfur.

EXAMPLE 2

In a 1000 ml flask are placed 30 g. of a commercially available ethylene/propylene/diene terpolymer wherein the diene is ethylidene norbornene (about 4 mole %) and the proprotion of ethylene to propylene is about 61/39 [Vistalon 4608, Enjay], 600 ml of heptane, and 100 ml of methylene dichloride. Stirring is continued for 4 hours. Then 2 g. of chlorosulfonyl isocyanate is added. (There are still pieces of undissolved but swelled rubber present at this point). The reaction is stirred for 24 hours, then stripped on a rotary evaporator into 270 g. of 100 neutral oil. Vacuum is then applied (about 2 mm) and the reaction mixture is stripped to a flask temperature of 120° C. After cooling to near room temperature, 6 g. of dimethylaminopropylamine is added, and the mixture is stirred for 1 hour. Then 1.0 g. of 50% aqueous NaOH is added, and the reaction is stripped at 0.5 mm to a flask temperature of 140° C. Infrared examination of the product before amine addition shows an adsorption at about 1830 $cm^{-1}$, characteristic of a $\beta$-lactam, which shifts to about 1600 $cm^{-1}$, characteristic of an amide, on addition of the amine. This product shows 6P (90° C.) and 4P (150° C.) asphaltenes dispersancy.

EXAMPLE 3 (COMPARATIVE)

Examples 3 and 4 demonstrate that residual unsaturation from a source other than a non-conjugated diene does not provide a useful product.

To a 500-ml roundbottomed 3-neck flask equipped with a nitrogen inlet, a stirrer, a condenser, and a thermometer are added 50 g. of a polymer of isobutylene-isoprene containing 4.64 mole % unsaturation, 51 g. of heptane, and 50 g. methylene dichloride. When the solution becomes homogeneous, 7.0 g. of chlorosulfonyl isocyanate (CSI) is added. While maintaining the reaction under nitrogen, stirring is conducted for 1 hour at ambient temperature (near 25° C.) with no measurable heat evolution, although moderate darkening occurs. The solution is allowed to stand for 64 hours, after which time solvents and unreacted CSI are removed under reduced pressure while adding 50.0 g. of 100 Neutral oil. The reaction product is finally stripped to a flask temperature of 100° C. at 0.5 mm. While maintaining the reaction at 110° C., 6.0 g. of diethylene triamine is rapidly added with stirring. The reaction mixture rapidly becomes extremely thick and gel-like. An additional 200 g. of 100 Neutral oil is added and the mixture heated to 140° C. After 2.5 hours of heating and stirring as well as possible, most of the product remains undissolved and gelled. The material is therefore unsuited for use as an oil additive.

EXAMPLE 4 (COMPARATIVE)

Twenty-five g. of isobutylene-isoprene polymer (Butyl 365, Exxon Chemicals, 2.0 mole % unsaturation), 100 ml of heptane, and 50 ml of methylene dichloride are added to the apparatus described in Example 3 and allowed to stand 16 hours. After this time solution of the polymer is complete. To the homogeneous solution is then added 5.0 g. of chlorosulfonyl isocyanate. The reaction mixture is stirred 1 hour and then allowed to stand for 24 hours under nitrogen. The solvents and excess CSI are removed under reduced pressure and 75.0 g. of 100 Neutral oil are added. Final stripping is performed to a flask temperature of 110° C. at 0.5 mm, and 5.0 g. of diethylene triamine are added. The polymer appears to be partially gelled even before the amine is added. The reaction mixture is stirred 6 hours at 100° C. at the end of which time most of the polymeric material remains insoluble. The material is therefore unsuited for use as an oil additive.

EXAMPLE 5 (COMPARATIVE)

This Example demonstrates that treatment with methanol as in U.S. Pat. No. 3,328,297 voids the dispersancy of the product.

A polymeric adduct is prepared substantially as described in Example 1 from 60 g. of Ortholeum 2052 and 4.5 g. of chlorosulfonyl isocyanate, and is stripped into 540 g. of 100 Neutral oil. A 100 g. portion of this oil solution is removed and treated with 2.0 g. of diethylene triamine at 110° C. for 2 hours. After further treatment with 0.5 g. of 50% aqueous NaOH and stripping, a 2P (150° C.) asphaltenes dispersant product is obtained.

To the remainder of the above oil solution of adduct were added 10.0 g. of anhydrous methanol. The mixture was heated and stirred at 60° C. for 2 hours, then vacuum stripped at 110° C. and 0.5 mm pressure. The resulting product was divided into five equal portions, four of which were treated respectively with 0.8 g. dimethyl-aminopropyl amine, 0.6 g. n-butyl amine, 1.0 g. of 40% aqueous dimethyl amine, and 2.0 g. of diethylene triamine. All four were heated at 110° C. for 2 hours, further treated with 0.5 g. of 50% aqueous NaOH, and stripped at 120° C. and 0.5 mm. The fifth sample was treated with 0.8 g. of dimethylaminopropyl amine at 140° C. for 2 hours, then worked up as described. None of the products showed asphaltenes dispersancy.

EXAMPLES 6-10

Other products were prepared substantially as described in Example 1 except for substitution of the amines listed below for the dimethylaminopropylamine of Example 1. The Asphaltenes dispersancies (150° C.) and total nitrogen content (some cases) of the resulting polymers are tabulated below.

| Amine post-reactant | | Asphaltenes Dispersancy | |
|---|---|---|---|
| Ex. No. | Amine | Asphaltenes Dispersancy | % Nitrogen (Kjeldahl) |
| 6 | 4-aminomethylpyridine | 2P | |
| 7 | N-3-aminopropylmorpholine | 3P | |
| 8 | diethylenetriamine | 5P | 0.92 |
| 9 | ethylenediamine | 4P | |
| 10 | triethylenetetramine | 5P | 1.17 |

I claim:

1. A polymeric additive for lubricating oils and hydrocarbon fuels, comprising an oil-soluble, viscosity index improving, non-conjugated diene-modified mono-olefinic backbone polymer containing about 1-10 mole % diene unsaturation, said backbone polymer being functionalized with chlorosulfonyl isocyanate and post-reacted with a nitrogen compound effective for imparting dispersant activity to said backbone polymer, said nitrogen compound being an amine having at least one primary or secondary amino group.

2. An additive as in claim 1 wherein said diene unsaturation is about 2.5-8.0 mole%.

3. An additive as in claim 1 wherein said backbone polymer is a diene-modified ethylene-propylene copolymer.

4. An additive as in claim 1 wherein said nitrogen compound is a polyamine.

5. An additive as in claim 1 wherein the diene modifier is ethylidene norbornene, methylene norbornene, 1,4-hexadiene or dicyclopentadiene, and the amine is a dialkylaminoalkylamine, an aminoalkylpyridine, an N-aminoalkylmorpholine, a polyalkylenepolyamine, or an alkylenepolyamine.

6. An additive as in claim 1 wherein the diene modifier is ethylidene norbornene, methylene norbornene, 1,4-hexadiene or dicyclopentadiene and the amine is dimethylaminopropylamine, 4-aminomethylpyridine, N-3-aminopropylmorpholine, diethylenetriamine, ethylenediamine, or triethylenetetramine.

7. An additive as in claim 1 wherein, prior to the post-reaction with nitrogen compound, the backbone polymer functionalized with the chlorosulfonyl isocyanate is reacted with bisulfite to remove the chlorosulfonyl functionality.

8. A composition comprising a major amount of a lubricating oil and a minor detergent amount of a polymeric additive comprising an oil-soluble, viscosity index improving, non-conjugated diene-modified mono-olefinic backbone polymer containing about 1-10% diene unsaturation, said backbone polymer being functionalized with chlorosulfonyl isocyanate and post-reacted with a nitrogen compound effective for imparting dispersant acitivity to said backbone polymer, said nitrogen compound being an amine having at least one primary or secondary amino group.

9. A composition as in claim 8 wherein said backbone polymer is a diene-modified ethylene-propylene copolymer.

10. A composition as in claim 8 wherein said diene unsaturation is about 2.5–8 mole %.

11. A composition as in claim 8 wherein said nitrogen compound is a polyamine.

12. A composition as in claim 8 wherein the diene modifier is ethylidene norbornene, methylene norbornene, 1,4-hexadiene or dicyclopentadiene, and the amine is a dialkylaminoalkylamine, an aminoalkylpyridine, an N-aminoalkylmorpholine, a polyalkylenepolyamine, or an alkylenepolyamine.

13. A composition as in claim 8 wherein the diene modifier is ethylidene norbornene, methylene norbornene, 1,4-hexadiene or dicyclopentadiene and the amine is dimethylaminopropylamine, 4-aminomethylpyridine, N-3-aminopropylmorpholine, diethylenetriamine, ethylenediamine, or triethylenetetramine.

14. A composition as in claim 8 wherein the polymeric additive, after functionalization with chlorosulfonyl isocyanate and before reaction with the nitrogen compound, is reacted with bisulfite to remove the chlorosulfonyl functionality.

15. A method for preparing a polymeric additive, comprising reacting an oil-soluble, viscosity index improving, non-conjugated diene-modified mono-olefinic backbone polymer containing about 1–10 mole % diene unsaturation with chlorosulfonyl isocyanate, and post-reacting the resulting functionalized backbone polymer with a nitrogen compound effective for imparting dispersant activity to the backbone polymer, said nitrogen compound being an amine having at least one primary or secondary amino group.

16. A method as in claim 15 wherein the post-reacted polymer is neutralized after said post-reaction.

17. A method as in claim 15 wherein, prior to the post-reaction, the functionalized backbone polymer is reacted with bisulfite to eliminate sulfur from said functionalized backbone polymer.

* * * * *